US012421757B1

(12) United States Patent
Jackson

(10) Patent No.: US 12,421,757 B1
(45) Date of Patent: Sep. 23, 2025

(54) RAPIDLY DEPLOYABLE WILDFIRE CONTAINMENT BARRIER

(71) Applicant: Dean Jackson, Toney, AL (US)

(72) Inventor: Dean Jackson, Toney, AL (US)

( * ) Notice: Subject to any disclaimer, the term of this patent is extended or adjusted under 35 U.S.C. 154(b) by 275 days.

(21) Appl. No.: 18/227,910

(22) Filed: Jul. 29, 2023

(51) Int. Cl.
*E04H 17/18* (2006.01)
*E04H 17/20* (2006.01)
*E04H 17/26* (2006.01)

(52) U.S. Cl.
CPC ..... *E04H 17/18* (2013.01); *E04H 17/23* (2021.01); *E04H 17/26* (2013.01)

(58) Field of Classification Search
CPC ..... E04H 17/18; E04H 17/23; E04H 17/26
See application file for complete search history.

(56) References Cited

U.S. PATENT DOCUMENTS 2,914,270 A 11/1959 Parker et al.
4,311,199 A 1/1982 Elias
4,858,395 A 8/1989 McQuirk
5,029,819 A 7/1991 Kane
5,809,699 A 9/1998 Joly
5,860,251 A 1/1999 Gleich
5,865,355 A 2/1999 Camara
5,937,883 A 8/1999 Camara
5,944,114 A 8/1999 Farley
6,092,792 A 7/2000 Camara
6,474,420 B1 11/2002 Adiga
6,658,801 B2 12/2003 Kilduff et al.
6,810,626 B2 11/2004 Meyer et al.
6,820,373 B1 11/2004 Bundy, Jr. et al.
7,165,626 B2 1/2007 Treddenick
7,225,882 B2 6/2007 Miller et al.
7,395,869 B2 7/2008 Schnabel et al.
7,686,094 B2 3/2010 Kleff
8,146,298 B2 4/2012 Bush et al.
8,215,055 B2 * 7/2012 Miller ..... A01G 9/28 47/31
8,297,371 B1 10/2012 Musser, Jr.
8,403,070 B1 3/2013 Lowe
8,708,267 B2 4/2014 Morgan
8,844,640 B2 9/2014 Linares
8,851,198 B2 10/2014 Burnham
8,925,252 B2 1/2015 Meager et al.
8,997,884 B1 4/2015 Morlier
9,174,107 B2 * 11/2015 Dettor ..... E04H 17/127
9,259,600 B2 2/2016 Cropper
9,283,413 B2 3/2016 Weber et al.
(Continued)

FOREIGN PATENT DOCUMENTS

EP 3747510 A1 9/2020

*Primary Examiner* — Brian D Mattei
(74) *Attorney, Agent, or Firm* — AdamsIP, LLC; Stephen Thompson; J. Hunter Adams

(57) ABSTRACT

A fabric barrier for containing wildfires can be rapidly deployed in a location within a path of a moving wildfire slow or stop the spread of the fire. The fabric can be rolled up and then deployed by unrolling the fabric and installing support posts at intervals along a length of the barrier. Stakes may be used to secure the installation to the ground. The barrier includes an upright portion that extends above the ground and a lateral portion that is positioned adjacent to the ground. A wheeled cart can be used to unroll and deploy the barrier along a path of deployment.

20 Claims, 6 Drawing Sheets

(56) References Cited

U.S. PATENT DOCUMENTS

| | | | |
|---|---|---|---|
| 9,486,656 | B2 | 11/2016 | Hutton |
| 9,731,154 | B2 | 8/2017 | Hutton |
| 9,750,962 | B2 | 9/2017 | Margolin |
| 10,151,334 | B1 | 12/2018 | MacIlvane |
| 10,780,302 | B2 | 9/2020 | West |
| 11,486,159 | B2 | 11/2022 | Shull |
| 11,633,635 | B2 | 4/2023 | Rocks et al. |
| 2005/0161235 | A1 | 7/2005 | Chuprin |
| 2005/0170725 | A1 | 8/2005 | Kimener |
| 2005/0269046 | A1 | 12/2005 | Freeman |
| 2007/0228349 | A1 | 10/2007 | Smith |
| 2009/0194297 | A1 | 8/2009 | Ortiz Teruel |
| 2009/0229840 | A1 | 9/2009 | Jimenez De Castro Fernandez |
| 2009/0260838 | A1 | 10/2009 | Jungermann |
| 2009/0266567 | A1 | 10/2009 | Musser, Jr. |
| 2010/0006306 | A1 | 1/2010 | Pezeshkian et al. |
| 2010/0175731 | A1 | 7/2010 | Day |
| 2010/0200251 | A1 | 8/2010 | Garcia et al. |
| 2010/0294520 | A1 | 11/2010 | Aguirre |
| 2010/0300707 | A1 | 12/2010 | Kolios |
| 2012/0112148 | A1 | 5/2012 | Hammond |
| 2019/0175964 | A1 | 6/2019 | Beecham |
| 2020/0238113 | A1 | 7/2020 | Glaser |
| 2021/0290996 | A1 | 9/2021 | Boussmiaa El Bourakadi |
| 2022/0120110 | A1* | 4/2022 | Potts ..... E04H 17/18 |
| 2022/0136279 | A1 | 5/2022 | Ismail |
| 2023/0250673 | A1* | 8/2023 | Hawthornthwaite ... E04H 17/22 256/31 |

* cited by examiner

RAPIDLY DEPLOYABLE WILDFIRE CONTAINMENT BARRIER

FIELD OF THE INVENTION

The present disclosure relates generally to a barrier system and method of using the barrier system to slow, reduce, or prevent the spread of wildfires.

BACKGROUND

Wildfires have always occurred naturally in many areas around the world. In recent years wildfires have been increasing in frequency and intensity, particularly in certain parts of the world. These fires are increasingly impacting homes and businesses as human development expands further into wilderness areas. Wildfires have enormous adverse consequences, including loss of life and property, deterioration of air quality, ecological damage, disruption of air and ground transportation, and large increases in expenses relating to firefighting activities, among other consequences. Once a wildfire has started, there are various methods commonly utilized to attempt to contain and extinguish the fire. Typically, water and/or fire-retardant chemicals are dropped from aircraft onto the fire or in the path of the fire. Controlled burns, clearcut logging, and forest thinning are other methods that may also be utilized to contain or slow the spread of wildfires or reduce the intensity of fires. Various types of physical barriers for containing wildfires have also been proposed, but these have not been widely implemented as tools for fighting wildfires. Some are not practical to deploy due to the extremely large size of the barrier, sometimes requiring aircraft to deploy the barrier over a wide area. Others, even if smaller in size, cannot be deployed rapidly enough over a wide area to contain a fast-moving fire.

SUMMARY

In one aspect, a physical barrier system and a method of deploying the barrier are provided. The system comprises a piece of fire-retardant fabric, a plurality of posts, and a plurality of stakes. The posts are engageable with the fabric to support a portion of the fabric in an upright position to form a fabric barrier that extends above a ground surface to slow, reduce, or prevent the spread of a wildfire. The fire-retardant fabric is capable of being rolled into a generally cylindrical roll in a rolled configuration and capable of being unrolled to form the fabric barrier. The fabric barrier has a length and a height when in a deployed configuration, with the length being greater than the height. The fabric barrier has a fold line that extends longitudinally along the length of the fabric barrier. The fold line defines a folding location and divides the fabric barrier into an upper portion and a lower portion. When in the deployed configuration, the posts support the upper portion of the fabric barrier in an upright position, and the fabric barrier is folded along the fold line so that the lower portion is disposed at an angle to the upper portion and is generally positioned adjacent to the ground surface. The stakes are driven into the ground to secure components of the fabric barrier system in the deployed configuration for wildfire containment.

The fabric barrier has a plurality of sleeves attached to a side of the fabric barrier and disposed in a spaced relation to each other along the length of the barrier. Each of the sleeves extends generally between the fold line and a top end of the fabric barrier. Each of the sleeves is sized to receive one of the posts within the sleeve and is open at a lower end of the sleeve to allow insertion of one of the posts into the sleeve. The fabric barrier also has a plurality of grommets disposed at a bottom end of the fabric barrier below the fold line. The grommets are disposed in a spaced relation to each other along the length of the barrier. Each of the grommets is sized to receive one of the stakes through the grommet to secure the lower portion of the barrier to the ground.

In a preferred embodiment, each of the posts comprises a support structure that extends laterally outward from a longitudinal axis of the post, and the support structure may comprise an opening sized to receive one of the stakes through the opening to secure the post to the ground. When each of the posts is inserted into a respective one of the sleeves and secured to the ground, the posts support the upper portion of the fabric barrier in an upright position, which is the deployed configuration of the barrier. The fabric barrier is then folded along the fold line so that the lower portion of the fabric barrier is disposed at an angle to the upper portion and positioned adjacent to the ground surface. The lower portion is then secured to the ground by driving stakes through each of the grommets, which completes deployment of the barrier.

In a preferred embodiment, the system further comprises a wheeled cart designed to rapidly deploy the barrier in any location. The cart comprises wheels and a handle for rolling the cart along a path on the ground surface along which the barrier is to be deployed. The cart further comprises a support rod sized to fit within a central opening of the roll when the fabric is in the rolled configuration such that the roll is supported by the support rod and is capable of rotating about an axis defined by the support rod to deploy the fabric barrier. When the roll of fabric is mounted onto the support rod, one of the support posts may be inserted into a sleeve at a distal end of the barrier and secured to the ground, at which point the cart may be rolled along the path of deployment to unroll the fabric barrier for deployment. As the barrier is unrolled, additional posts may be inserted into each subsequent sleeve and secured to the ground to support the barrier in the upright, deployed configuration. This system allows rapid deployment of the barrier with minimal manpower.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DESCRIPTION OF THE DRAWINGS

These and other features, aspects, and advantages of the present invention will become better understood with regard to the following description, appended claims, and accompanying drawings where:

DETAILED DESCRIPTION

Figure 1:
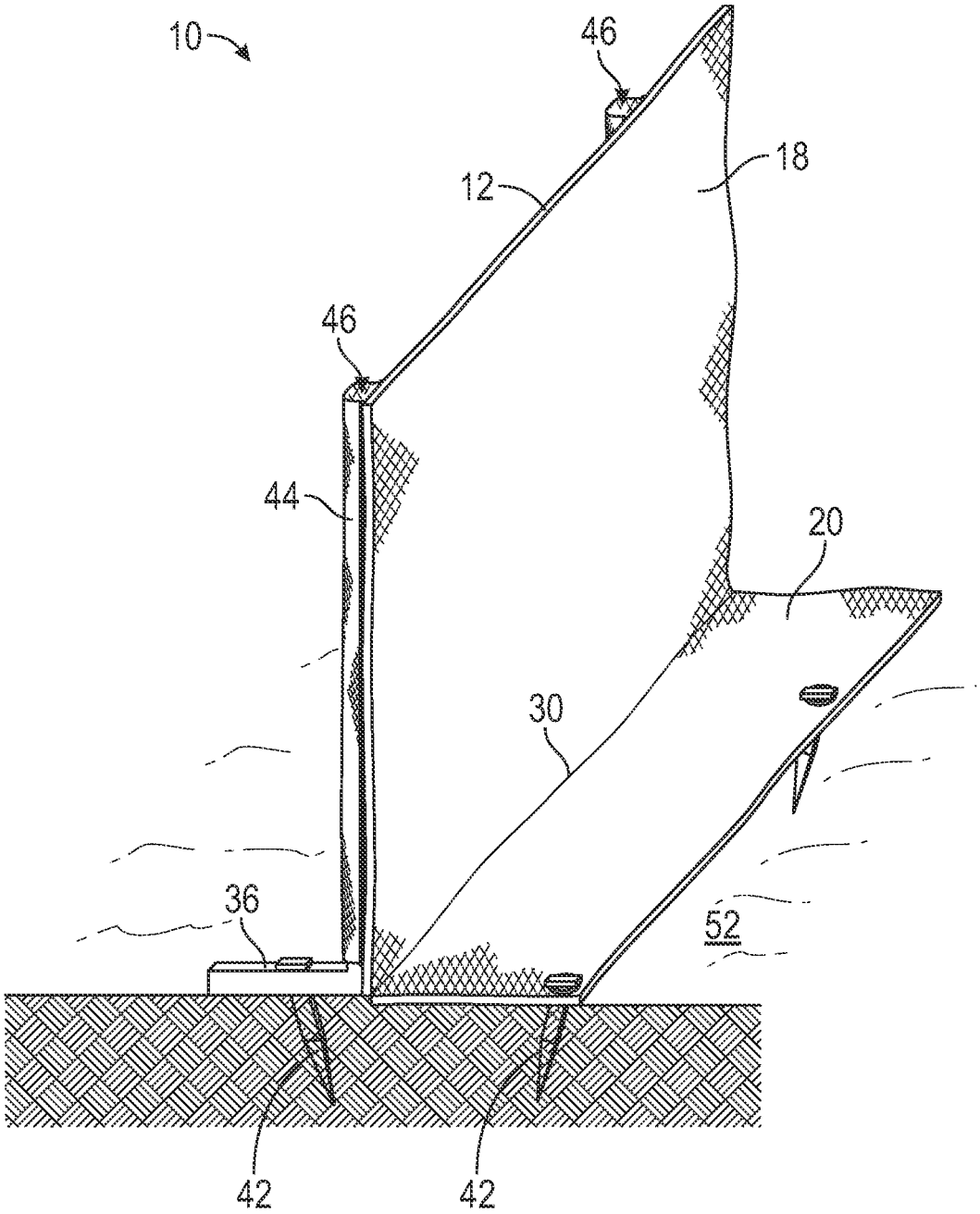
FIG. 1 shows a perspective view of a fire-retardant barrier system in accordance with the present disclosure.

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

In one aspect, a physical barrier system 10 is provided. FIGS. 1-7 illustrate preferred embodiments of the system 10 or components thereof. The system 10 comprises a piece of fire-retardant fabric that forms a barrier 12 for containing a fire, a plurality of posts 32 for supporting the barrier 12, and a plurality of stakes 42 for securing components of the system 10 to a ground surface 52. When deployed, a portion 18 of the fabric barrier 12 extends above the ground surface 52 in an upright position to function as a containment barrier for a moving fire. The fabric 12 is a generally flexible piece of material that is constructed of a material capable of slowing, reducing, or stopping the spread of a fire. The material preferably functions as a thermal insulator and is resistant to ignition and is self-extinguishing. The material is capable of withstanding high temperatures typically experienced during fires without melting or breaking apart. In a preferred embodiment, the fabric 12 is a ceramic fiber cloth or a fiberglass cloth, though other flexible materials suitable for high temperature applications and having fire-retardant characteristics may be utilized and still fall within the scope of the present disclosure.

Figure 4:
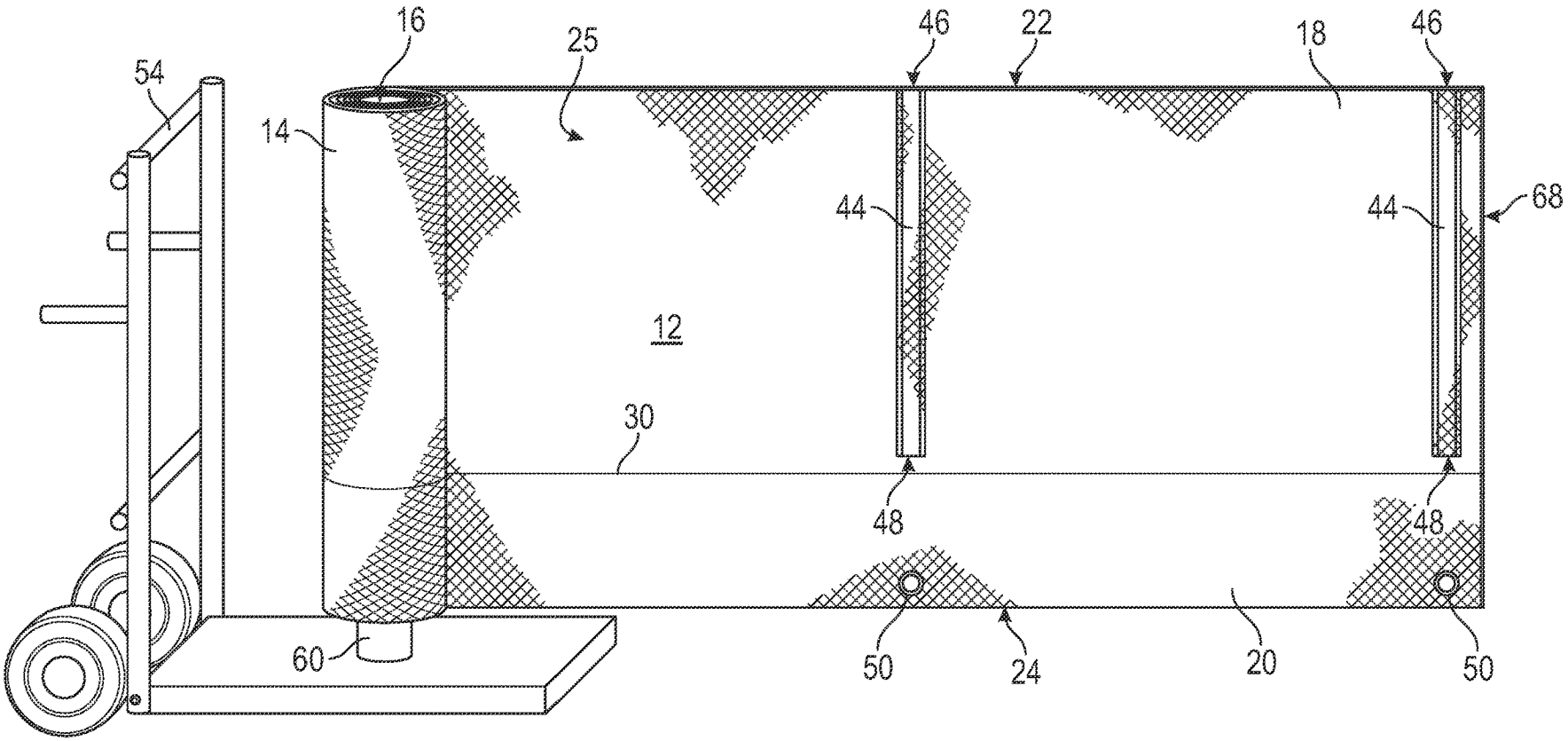
FIG. 4 shows a side view of a roll of fire-retardant fabric being deployed using a wheeled cart in accordance with the present disclosure.
Figure 5:
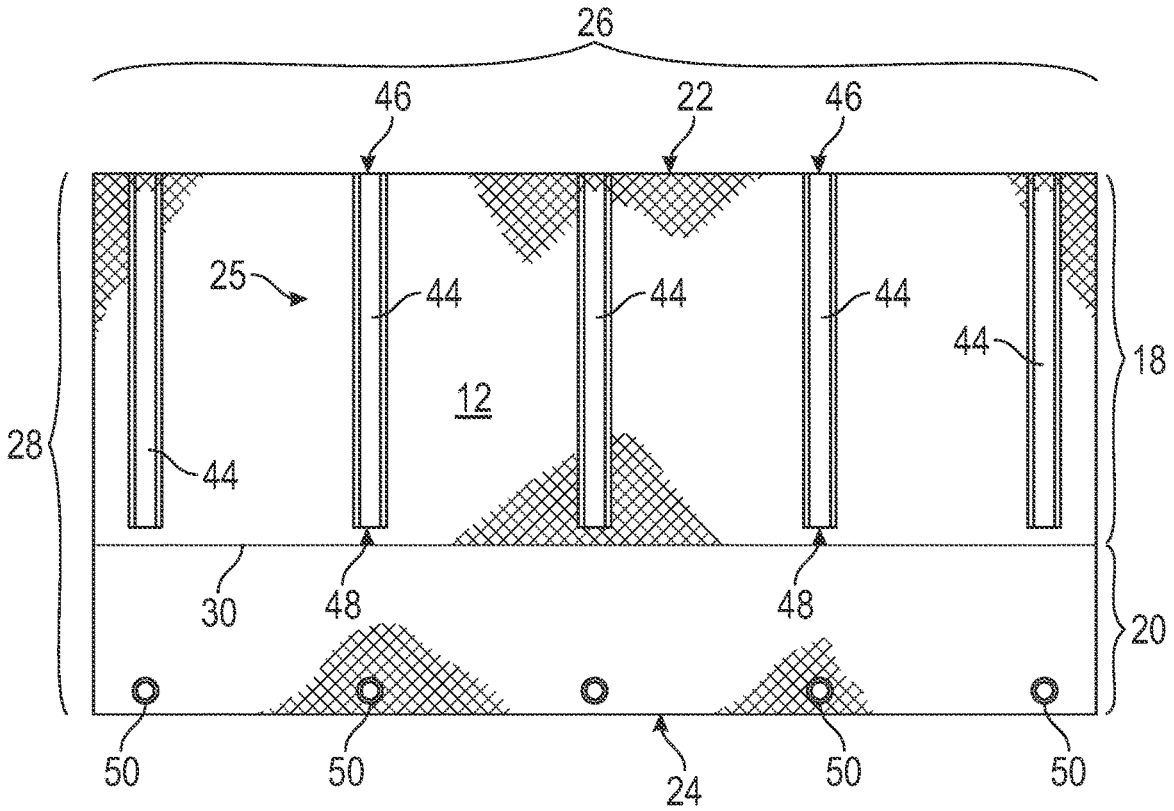
FIG. 5 shows a side view of a length of a fire-retardant fabric barrier in accordance with the present disclosure.
Figure 6:
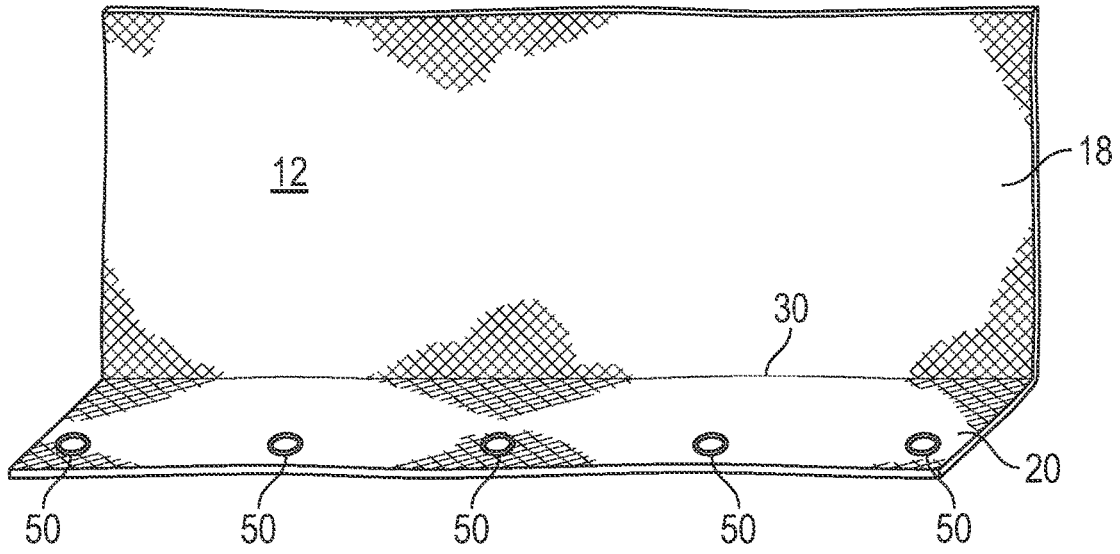
FIG. 6 shows a perspective view of a length of a fire-retardant fabric barrier in accordance with the present disclosure.
Figure 7:
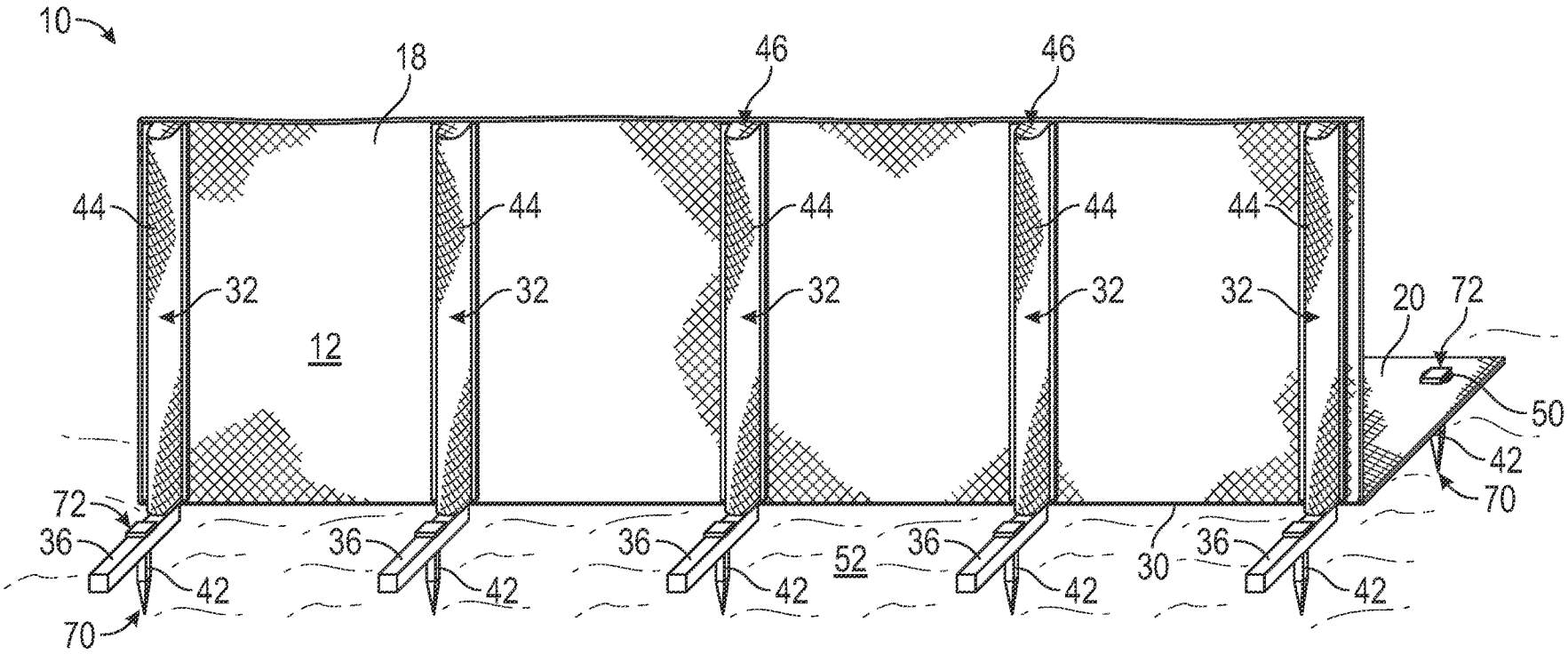
FIG. 7 shows a perspective view of a fire-retardant barrier system in accordance with the present disclosure.

The posts 32 are engageable with the fabric 12 to support a portion 18 of the fabric 12 in an upright position to form a fabric barrier 12 that extends above a ground surface 52 to provide a physical barrier to the spread of a wildfire. The fire-retardant fabric 12 is capable of being rolled into a generally cylindrical roll 14 in a rolled configuration, as shown in FIG. 4, and capable of being unrolled to form the fabric barrier 12, as best seen in FIGS. 1 and 7, which show the barrier 12 in a deployed configuration. The fabric barrier 12 has a length 26 and a height 28 when in the deployed configuration, with the length 26 being greater than the height 28. As best seen in FIGS. 4-6, the fabric barrier 12 has a fold line 30 that extends longitudinally along the length 26 of the fabric barrier 12. The fold line 30 defines a folding location and divides the fabric barrier 12 into an upper portion 18 and a lower portion 20, as best seen in FIG. 5. When in the deployed configuration, the posts 32 support the upper portion 18 of the fabric barrier 12 in an upright position, and the fabric barrier 12 is folded along the fold line 30 so that the lower portion 20 is disposed at an angle to the upper portion 18 and is generally positioned adjacent to a ground surface 52 so that the lower portion 20 covers an area of the ground surface 52, as best seen in FIG. 1. The stakes 42 are driven into the ground 52 to secure components of the fabric barrier system 10 in the deployed configuration for wildfire containment. In a preferred embodiment, each stake 42 has a pointed lower end 70 for penetrating the ground 52 and a flanged upper end 72 for retaining components of the system 10 in place after driving the stake 42 into the ground 52.

The fabric barrier 12 has a plurality of sleeves 44 attached to a side 25 of the fabric barrier 12 and disposed in a spaced relation to each other 44 along the length 26 of the barrier 12. As best seen in FIG. 5, each of the sleeves 44 extends generally between the fold line 30 and a top end 22 of the fabric barrier 12. Each of the sleeves 44 is sized to receive one of the posts 32 within the sleeve 44 to support the upper portion 18 of the barrier 12 in an upright position. FIG. 5 shows one side 25 of the fabric barrier 12 before folding, and FIG. 6 shows the opposite side of the fabric barrier 12 after folding along the fold line 30. In one embodiment, the fabric 12 has sleeves 44 on only one side 25 of the fabric 12, which is the side 25 opposite the direction of folding the lower portion 20 of the barrier 12 when in the deployed configuration. Alternatively, the fabric 12 may have sleeves 44 on both sides of the fabric 12 so that the lower portion 20 may be folded in either direction relative to the upper portion 18 during deployment. Sleeves 44 on the opposite side of the lower portion 20, regardless of which way the lower portion 20 is folded, may then be utilized to secure the barrier 12 in the upright position.

In a preferred embodiment, each of the sleeves 44 is made of the same material as the rest of the fabric barrier 12, and each sleeve 44 is sewn onto the fabric 12. The flexible sleeves 44 each have a maximum internal diameter that is large enough to receive one of the support posts 32 into the sleeve 44. The diameter of each of the sleeves 44 and the diameter of each of the posts 32 are preferably sized so that the sleeves 44 fit snugly around each post 32 to prevent the fabric barrier 12 from sliding down on the posts 32 after deployment. Each sleeve 44 has an upper end 46 near the top end 22 of the barrier 12 and a lower end 48 near the fold line 30 of the barrier 12. Each sleeve 44 is open at the lower end 48 of the sleeve 44 to allow insertion of one of the posts 32 into the sleeve 44 through the lower end 48. In one embodiment, the upper end 46 of each sleeve 44 may be closed to prevent the fabric barrier 12 from sliding down the posts 32 after deployment. In a preferred embodiment, each sleeve 44 extends continuously between the upper end 46 and the lower end 48, as best seen in FIG. 5. This allows a user to fully insert each post 32 into one of the sleeves 44 quickly by first inserting an upper end 35 of a post 32 into the lower open end 48 of a sleeve 44 and then simply pushing the post 32 fully into the sleeve 44. Alternatively, each sleeve 44 may not be continuous and may have open portions along the length of the sleeve 44. In one alternative embodiment, each sleeve 44 may comprise a plurality of loops attached to the fabric 12 and aligned with each other to receive a post 32 through all of the loops to support the fabric barrier 12 in the upright position.

The fabric barrier 12 further comprises a plurality of grommets 50 disposed at a bottom end 24 of the fabric barrier 12 below the fold line 30, as best seen in FIG. 5. The grommets 50 are disposed in a spaced relation to each other 50 along the length 26 of the barrier 12. Each of the grommets 50 is sized to receive one of the stakes 42 through the grommet 50 to secure the lower portion 20 of the barrier 12 to the ground 52. In a preferred embodiment, each grommet 50 comprises a metal ring that is securely attached to the fabric 12 near the bottom end 24 of the fabric 12 to provide a reinforced opening extending through the fabric 12 through which a stake 42 may be driven to secure the lower portion 20 of the fabric barrier 12 in place. Alternatively, the grommets 50 may be a ring that is not installed in the fabric 12 itself but is otherwise attached to the fabric 12 at or near the bottom end 24, for instance by a rope, cord, or chain, or by an extended piece of the fabric itself. In another alternative embodiment, small spikes may be attached to the bottom end 24 of the fabric barrier 12, for instance by a rope, cord, or chain, or by an extended piece of the fabric itself, and these spikes may be inserted into the ground 52 to secure the lower portion 20 of the fabric barrier 12 in place.

In a preferred embodiment, as best seen in FIG. 5, the fabric barrier 12 generally has an elongated rectangular shape when unrolled into the deployed configuration. Each of the top end 22 and bottom end 24 of the fabric 12 is defined by an edge, and the edges of the top 22 and bottom 24 ends are generally parallel to each other and also each generally parallel to the fold line 30. In a preferred embodiment, the fold line 30 is defined by a seam sewn into the fabric barrier 12 at the folding location. The seam 30 may be designed to allow the fabric 12 to fold more easily at the precise location of the fold line 30. The presence of the seam 30 may also make it easier for an installer to quickly identify the correct folding location and then fold the fabric 12 at the correct location during deployment, thereby minimizing the time required for the installer to deploy the barrier 12. Each of the sleeves 44 is preferably arranged perpendicularly to the top end 22, bottom end 24, and fold line 30 of the fabric barrier 12.

In one preferred embodiment, the length 26 of one roll 14 of fabric 12 is at least 50 feet, and preferably 60 feet or longer, and the height 28 of one roll 14 is at least 6.5 feet. The height of the upper portion 18 of the barrier 12 is preferably at least 5 feet, and the height of the lower portion 20 of the barrier 12 is preferably at least 1.5 feet. Thus, in a preferred embodiment, the barrier 12 extends at least 5 feet above the ground surface 52 on which the barrier 12 is installed, and the lower portion 20 preferably extends laterally outward at least 1.5 feet from the upright upper portion 18 when the lower portion 20 is folded during deployment of the barrier system 10. Each of the sleeves 44, and thus each of the posts 32 inserted into the sleeves 44, are preferably spaced apart a distance of about 10 to 15 feet from each other. It should be noted that the figures showing the fabric barrier 12 and other components of the system 10 are intended to illustrate the functionality of the system 10 and may not be to scale.

When the system 10 is deployed, the system 10 is preferably installed such that the lower portion 20 is folded toward the direction that the fire is moving so that when the fire approaches the deployed barrier 12 the fire contacts both the upper 18 and lower 20 portions of the barrier 12. The positioning of the upper portion 18 is designed to contain flames as well as thermal energy of the fire, and the lower portion 20 helps to prevent the fire from burning grass, leaves, brush, or other vegetation close to the ground 52, which helps to prevent the fire from burning underneath the fabric barrier 12 and thereby escaping containment of the barrier 12 by igniting vegetation on the opposite side of the barrier 12 relative to the direction of movement of the fire. In other embodiments, the height of both the upper 18 and lower 20 portions of the barrier 12, as well as the overall length 26 of the barrier 12, may be varied and still fall within the scope of the present disclosure. For instance, the height of the upper portion 18 of the barrier 12 may be increased when using the system 10 for containing larger fires that are burning material higher off of the ground 52. The height of the lower portion 20 may also be increased, for instance, when using the system 10 for containing fires in areas with significant vegetation close to the ground 52. In some applications, the system 10 may be utilized to surround one or more homes or other property, in which case the height of the upper portion 18 may be increased to help protect the home from flames. The present system 10 may also help to minimize smoke and soot damage to homes or other property protected by the barrier 12.

Figure 2:
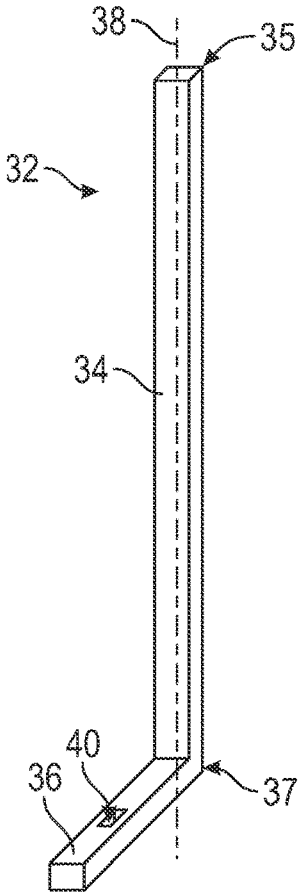
FIG. 2 shows a perspective view of a post for use with a fire-retardant barrier system in accordance with the present disclosure.

Each post 32 comprises an elongated rod 34 sized for insertion into one of the sleeves 44 of the fabric 12 and sufficiently rigid for supporting the fabric barrier 12 in an upright position, as shown in FIG. 1. In a preferred embodiment, as best seen in FIG. 2, each of the posts 32 comprises a support structure 36 that extends laterally outward from a longitudinal axis 38 of the post 32, which is defined by the elongated rod 34. In a preferred embodiment, the support structure 36 comprises an opening 40 sized to receive one of the stakes 42 through the opening 40 to secure the post 32 to the ground 52, as best seen in FIG. 7. In a preferred embodiment, each post 32 is generally L-shaped. In this embodiment, each post 32 comprises a first member 34 and a second member 36 rigidly attached to the first member 34, and the second member 36 is generally perpendicular to the first member 34 to form the L-shaped post 32. The first member 34 forms the elongated rod that is inserted into one of the sleeves 44, and the second member 36 functions as the support structure, which provides additional support to the post 32 for enhanced stability when the system 10 is deployed. Wildfires often produce intense winds in the vicinity of the fire, and the support structure 36 enhances the stability of the fabric barrier 12 when winds impact the barrier 12. In a preferred embodiment, as best seen in FIG. 1, the second member 36 extends laterally outward in the opposite direction of the lower portion 20 of the fabric 12, which is installed facing into the direction from which the fire is moving toward the barrier 12. The direction in which the fire moving is the same direction from which strong winds are likely to move. Thus, the second member 36 is positioned to stabilize the barrier 12 against winds impacting the barrier 12 on the opposite side of the fabric 12 from the second member 36, which is the side of the barrier 12 likely to be impacted by winds originating from the fire. The second member 36 is preferably shorter in length than the first member 34 so that the barrier 12 may be supported at an adequate height while minimizing the overall size of each post 32.

Figure 2A:
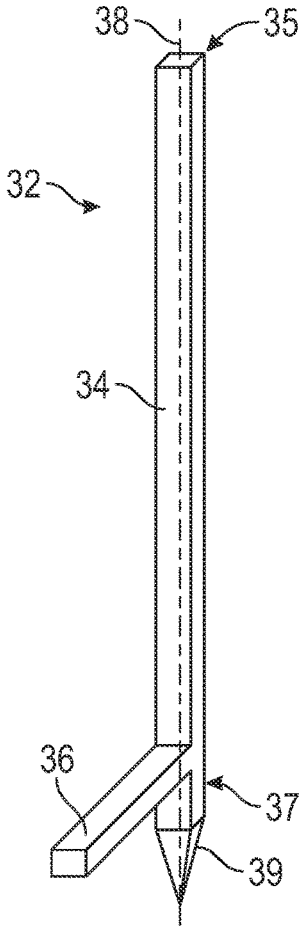
FIG. 2A shows a perspective view of an alternative embodiment of a post for use with a fire-retardant barrier system in accordance with the present disclosure.

In an alternative embodiment, as shown in FIG. 2A, each of the posts 32 comprises a spike 39 at a lower end 37 of the post 32 that is capable of being driven into the ground 52 to support the post 32 in a generally upright position relative to the ground 52. The spike 39 is preferably integrally attached to the post 32 and is longitudinally aligned with the axis 38 defined by the elongated rod 34. The spike 39 may be made of the same material as other portions of the post 32 and may be formed by an extension of the material forming rod 34. The spike 39 preferably has a pointed lower end for penetrating the ground 52. In this embodiment, the post 32 preferably includes the support structure 36 extending laterally outward from the longitudinal axis 38 of the post 32 for enhanced stability. In this embodiment, the spike 39 may be used to support the post 32 in the upright position instead of a stake 42 driven through opening 40 in support structure 36, or the spike 39 may optionally be used in combination with a separate stake 42 driven through opening 40 to support of the post 32 in the ground 52 more securely. The support structure 36 preferably extends laterally outward from the lower end 37 of the elongated rod 34 to which the spike 39 is attached so that the support structure 36 is contacting the surface of the ground 52 when the spike 39 is fully inserted into the ground 52.

When each of the posts 32 is inserted into a respective one of the sleeves 44 and secured to the ground 52 using stakes 42, spikes 39, or a combination thereof, the posts 32 support the upper portion 18 of the fabric barrier 12 in an upright position, as shown in FIGS. 1 and 7, which is the deployed configuration of the barrier 12.

Figure 3:
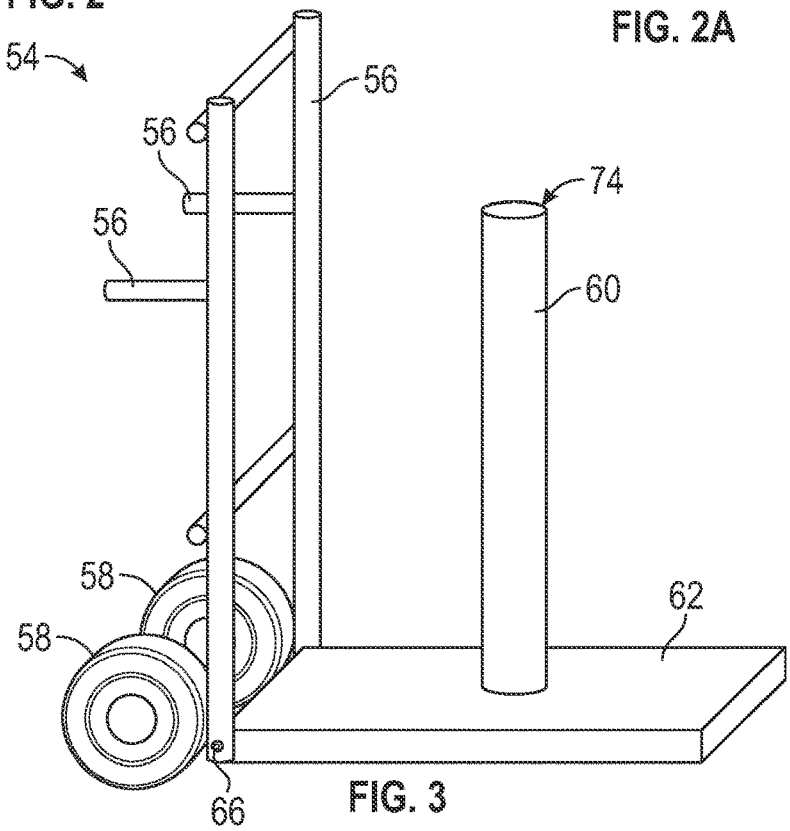
FIG. 3 shows a perspective view of a wheeled cart for use with a fire-retardant barrier system in accordance with the present disclosure.

In a preferred embodiment, the system 10 further comprises a wheeled cart 54 designed to rapidly deploy the barrier 12 in any location. FIG. 3 illustrates the cart 54 only, and FIG. 4 shows the cart 54 being used to deploy the fabric barrier 12. The cart 54 comprises handles 56 for a user to manually operate the cart 54 and wheels 58 for rolling the cart 54 along a path on the ground surface 52 along which the barrier 12 is to be deployed. The cart 54 may be operated only manually or may optionally include a motor for driving motion of the cart 54, in which case the handles 56 may be used for guiding the cart 54. The wheels 58 may be designed to be suitable for operation over rough, uneven terrain. The cart 54 further comprises a support rod 60 sized to fit within a central opening 16 of the roll 14 when the fabric 12 is in the rolled configuration, as shown in FIG. 4, which shows a portion of the barrier 12 being unrolled for deployment. When the support rod 60 is inserted into the central opening 16 of the roll 14, the roll 14 is supported by the support rod 60 and is capable of rotating about an axis defined by the support rod 60 to deploy the fabric barrier 12 from the cart 54 as the cart 54 is rolled along the ground surface 52. In one embodiment, the central opening 16 of the roll 14 has an internal diameter that is larger than an outer diameter of the support rod 60 so that the roll 14 is capable of rotating about the support rod 60, which is mounted in a rotatably fixed position. Alternatively, the central opening 16 of the roll 14 may have an internal diameter that is approximately the same as the outer diameter of the support rod 60 so that the roll 14 fits tightly onto the support rod 60. In this embodiment, the support rod 60 may be rotatably mounted onto the cart 54 so that the rod 60 rotates as the fabric 12 is unrolled during deployment.

Figure 3A:
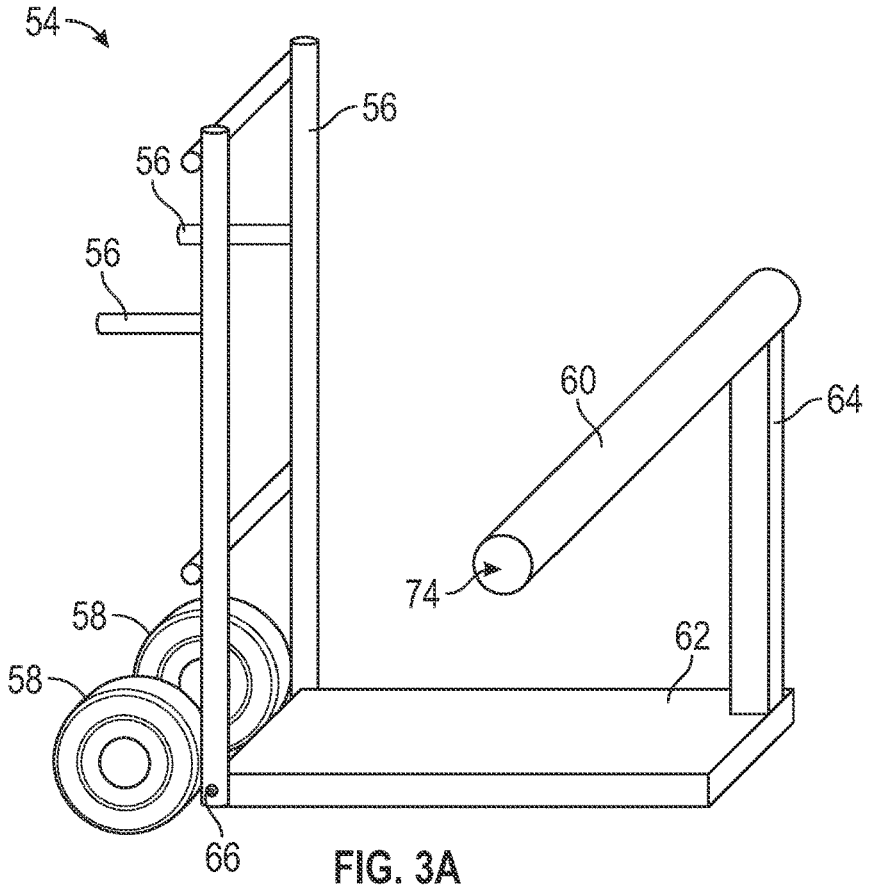
FIG. 3A shows a perspective view of an alternative embodiment of a wheeled cart for use with a fire-retardant barrier system in accordance with the present disclosure.
Figure 3B:
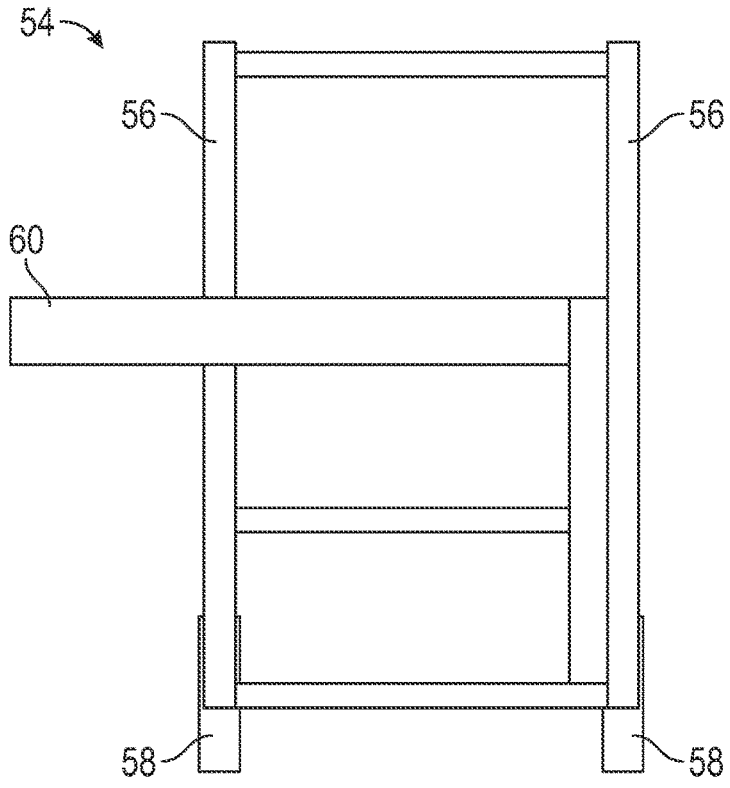
FIG. 3B shows a front view of an alternative embodiment of a wheeled cart for use with a fire-retardant barrier system in accordance with the present disclosure.

In a preferred embodiment, as shown in FIGS. 3 and 4, the support rod 60 is disposed in a generally vertical position when the cart 54 is in an upright position with the wheels 58 on the ground 52 for deploying the fabric barrier 12. In an alternative embodiment, as shown in FIGS. 3A and 3B, the support rod 60 may be disposed in a generally horizontal position when the cart 54 is in an upright position for deploying the fabric barrier 12. The support rod 60 may be connected to a lower support structure 62 that is connected to the handles 56. In a preferred embodiment, the lower support structure is a platform 62 or similar structure onto which the support rod 60 is mounted in either the vertical or horizontal position. When mounted in the horizontal position, the cart 54 may include a vertical support 64 onto which the support rod 60 is mounted to support the rod 60 in an elevated position above the platform 62. The support rod 60 is preferably attached to the cart 54 at only one end of the support rod 60 so that the roll 14 of fabric 12 may be mounted over a free end 74 of the support rod 60, as shown in FIG. 4. The cart 54 may optionally include a latching mechanism to retain the roll 14 in place after the roll 14 is mounted onto the support rod 60. In a preferred embodiment, the platform 62 onto which the support rod 60 is mounted may be hingedly connected to the handle 56 by a pair of hinges 66 such that the platform 62 is capable of pivoting relative to the handle 56. This may allow the platform 62 to remain in a generally horizontal position while tilting the handles 56 for ease of operating the cart 54.

To deploy the barrier system 10, one or more rolls 14 of fabric 12 are transported to a deployment site in the path of a fire or around one or more structures or other property that may potentially be in the path of a fire. A roll 14 of fabric 12 may then be mounted onto the cart 54 so that the roll 14 can rotate during deployment. An installer may then manually hold a distal end 68 of the fabric barrier 12 and begin to unroll the fabric 12. To hold the distal end 68 of the barrier 12 in place while the fabric 12 is unrolled, a support post 32 may be inserted into the sleeve 44 nearest the distal end 68 and secured to the ground 52, or a stake 42 may be inserted into the grommet 50 nearest the distal end 68 to secure the lower portion 20 of the barrier 12 to the ground 52. The cart 54 may be rolled along the path of deployment while the distal end 68 of the barrier 12 is retained in place to allow the fabric barrier 12 to unroll. As the fabric 12 is unrolled, additional posts 32 may be inserted into each sleeve 44 and then secured to the ground 52 to support the upper portion 18 of the barrier 12 in the upright, deployed configuration. The posts 32 may be secured to the ground 52 by driving a stake 42 through the opening 40 in the second member 36 of the post 32, by driving a spike 39 at a lower end 37 of the post 32, or using a combination of both a stake 42 and spike 39. The fabric barrier 12 is then folded along the fold line 30 so that the lower portion 20 of the fabric barrier 12 is disposed at an angle to the upper portion 18 and positioned adjacent to the surface of the ground 52. The lower portion 20 may then be secured to the ground 52 by driving stakes 42 through each of the grommets 50.

When unrolling the fabric 12 during deployment, the fabric 12 may initially be laid flat on the ground 52 in a configuration in which the fabric 12 is folded 180 degrees along the fold line 30 so that the upper portion 18 of the fabric 12 is laying flat on top of the lower portion 20. In this configuration, the sleeves 44 will be on the side 25 of the fabric 12 facing upwards so that the sleeves 44 are accessible to an installer. The installer may then fully insert each of the posts 32 into a respective one of the sleeves 44, and then the upper portion 18 of the barrier 12 may be erected by standing each of the posts 32 and securing the posts 32 to the ground 52 in an upright position. Once the upper portion 18 has been erected, the lower portion 20 may be fully extended along the ground surface 52 from the fold line 30 and secured to the ground 52 using the stakes 42 to complete the deployment of the fabric barrier 12. After this process has been completed with one roll 14 of fabric barrier 12, additional rolls 14 of fabric 12 may be deployed in the same manner so that a plurality of rolls 14 are deployed to produce a barrier 12 of any desired overall length. The present system 10 and method of deployment allows for rapid deployment of multiple fabric barriers 12 with minimal manpower.

In one embodiment, a small gap may be left between pairs of adjacent deployed barriers 12 to allow a space for wildlife to escape containment of the barrier 12. In a preferred embodiment, the ends of adjacent barriers 12 may be staggered in an overlapping manner in such a way that leaves a gap between adjacent barriers 12 for wildlife to escape but does not leave a gap between adjacent barriers 12 in the direction in which the wildfire is moving so that the fire cannot easily spread past the barriers 12 by moving in a straight line between the adjacent barriers 12.

It will be appreciated that the configurations and methods shown and described herein are illustrative only, and that these specific examples are not to be considered in a limiting sense, because numerous variations are possible. The subject matter of the present disclosure includes all novel and non-obvious combinations and sub-combinations of the various systems and configurations, and other features, functions, and/or properties disclosed herein. It is understood that versions of the invention may come in different forms and embodiments. Additionally, it is understood that one of skill in the art would appreciate these various forms and embodiments as falling within the scope of the invention as disclosed herein.

What is claimed is:

1. A fabric barrier system comprising:

a fire-retardant fabric barrier;

a plurality of posts; and a plurality of stakes, wherein the fabric barrier has a length and a height, wherein the length is greater than the height, wherein the fabric barrier has a fold line that extends longitudinally along the length of the fabric barrier, wherein the fold line defines a folding location and divides the fabric barrier into an upper portion and a lower portion, wherein the fabric barrier has a plurality of sleeves attached to a side of the fabric barrier and disposed in a spaced relation to each other, wherein each of the plurality of sleeves extends between the fold line and a top end of the fabric barrier, wherein each of the plurality of sleeves is sized to receive a respective one of the plurality of posts within the sleeve, wherein each of the plurality of sleeves is open at a lower end of the sleeve to allow insertion of a respective one of the plurality of posts into the sleeve, wherein the fabric barrier has a plurality of grommets disposed at a bottom end of the fabric barrier below the fold line, wherein the plurality of grommets are disposed in a spaced relation to each other, wherein each of the plurality of grommets is sized to receive one of the plurality of stakes through the grommet, and wherein each of the plurality of posts comprises a support structure that extends laterally outward from a longitudinal axis of the post, wherein the support structure comprises an opening sized to receive one of the plurality of stakes through the opening.

2. The system of claim 1, wherein the fold line is defined by a seam sewn into the fabric barrier at the folding location.

3. The system of claim 1, further comprising a cart comprising wheels and a handle, wherein the cart further comprises a support rod sized to fit within a central opening of a roll of the fabric barrier such that the roll is supported by the support rod and is capable of rotating about an axis defined by the support rod.

4. The system of claim 3, wherein the support rod is disposed in a vertical position when the cart is in an upright position for deploying the fabric barrier.

5. The system of claim 3, wherein the support rod is disposed in a horizontal position when the cart is in an upright position for deploying the fabric barrier.

6. The system of claim 3, wherein the support rod is connected to a lower support structure that is hingedly connected to the handle such that the lower support structure is capable of pivoting relative to the handle.

7. The system of claim 3, wherein the support rod is attached to the cart at only one end of the support rod.

8. The system of claim 1, wherein each of the plurality of posts comprises a first member and a second member rigidly attached to the first member, wherein the second member is generally perpendicular to the first member, wherein the longitudinal axis of the post is defined by the first member, and wherein the support structure that extends laterally outward from the longitudinal axis is defined by the second member.

9. A fabric barrier system comprising:

a piece of fire-retardant fabric capable of being rolled into a generally cylindrical roll in a rolled configuration and capable of being unrolled to form a fabric barrier having a length and a height in a deployed configuration, wherein the length is greater than the height in the deployed configuration;

a plurality of posts; and a plurality of stakes, wherein the fabric barrier has a fold line that extends longitudinally along the length of the fabric barrier, wherein the fold line defines a folding location and divides the fabric barrier into an upper portion and a lower portion, wherein the fabric barrier has a plurality of sleeves attached to a side of the fabric barrier and disposed in a spaced relation to each other, wherein each of the plurality of sleeves extends between the fold line and a top end of the fabric barrier, wherein each of the plurality of sleeves is sized to receive a respective one of the plurality of posts within the sleeve, wherein each of the plurality of sleeves is open at a lower end of the sleeve to allow insertion of a respective one of the plurality of posts into the sleeve, wherein the fabric barrier has a plurality of grommets disposed at a bottom end of the fabric barrier below the fold line, wherein the plurality of grommets are disposed in a spaced relation to each other, wherein each of the plurality of grommets is sized to receive one of the plurality of stakes through the grommet, and wherein each of the plurality of posts comprises a support structure that extends laterally outward from a longitudinal axis of the post, wherein the support structure comprises an opening sized to receive one of the plurality of stakes through the opening, wherein the plurality of posts supports the upper portion of the fabric barrier in an upright position when in the deployed configuration in which each of the plurality of posts is inserted into a respective one of the sleeves, wherein the fabric barrier is folded along the fold line so that the lower portion of the fabric barrier is disposed at an angle to the upper portion and positioned adjacent to a ground surface when the fabric is in the deployed configuration.

10. The system of claim 9, wherein the fold line is defined by a seam sewn into the fabric barrier at the folding location.

11. The system of claim 9, further comprising a cart comprising wheels and a handle, wherein the cart further comprises a support rod sized to fit within a central opening of the roll when the fabric is in the rolled configuration such that the roll is supported by the support rod and is capable of rotating about an axis defined by the support rod.

12. The system of claim 11, wherein the support rod is disposed in a vertical position when the cart is in an upright position for deploying the fabric barrier.

13. The system of claim 11, wherein the support rod is disposed in a horizontal position when the cart is in an upright position for deploying the fabric barrier.

14. The system of claim 11, wherein the support rod is connected to a lower support structure that is hingedly connected to the handle such that the lower support structure is capable of pivoting relative to the handle.

15. The system of claim 11, wherein the support rod is attached to the cart at only one end of the support rod.

16. The system of claim 9, wherein each of the plurality of posts comprises a first member and a second member rigidly attached to the first member, wherein the second member is generally perpendicular to the first member, wherein the longitudinal axis of the post is defined by the first member, and wherein the support structure that extends laterally outward from the longitudinal axis is defined by the second member.

17. A fabric barrier system comprising:

a fire-retardant fabric barrier;

a plurality of posts; and a plurality of stakes, wherein the fabric barrier has a length and a height, wherein the length is greater than the height, wherein the fabric barrier has a fold line that extends longitudinally along the length of the fabric barrier, wherein the fold line defines a folding location and divides the fabric barrier into an upper portion and a lower portion, wherein the fabric barrier has a plurality of sleeves attached to a side of the fabric barrier and disposed in a spaced relation to each other, wherein each of the plurality of sleeves extends between the fold line and a top end of the fabric barrier, wherein each of the plurality of sleeves is sized to receive a respective one of the plurality of posts within the sleeve, wherein each of the plurality of sleeves is open at a lower end of the sleeve to allow insertion of a respective one of the plurality of posts into the sleeve, wherein the fabric barrier has a plurality of grommets disposed at a bottom end of the fabric barrier below the fold line, wherein the plurality of grommets are disposed in a spaced relation to each other, wherein each of the plurality of grommets is sized to receive one of the plurality of stakes through the grommet, and wherein each of the plurality of posts comprises a spike at a lower end of the post that is capable of being driven into a ground support to support the post in a generally upright position relative to the ground support.

18. The system of claim 17, wherein each of the plurality of posts comprises a support structure that extends laterally outward from a longitudinal axis of the post.

19. The system of claim 17, wherein the fold line is defined by a seam sewn into the fabric barrier at the folding location.

20. The system of claim 17, further comprising a cart comprising wheels and a handle, wherein the cart further comprises a support rod sized to fit within a central opening of a roll of the fabric barrier such that the roll is supported by the support rod and is capable of rotating about an axis defined by the support rod.

* * * * *